United States Patent [19]

Marchesini et al.

[11] 4,104,893

[45] Aug. 8, 1978

[54] APPARATUS FOR CONTINUOUS DYEING OF TEXTILES

[76] Inventors: Bruno Marchesini, via del Colle, Trissino (Vicenza); Fernando Martini, via Trento, Piovene Rocchette (Vicenza), both of Italy

[21] Appl. No.: 685,300

[22] Filed: May 11, 1976

[30] Foreign Application Priority Data

Aug. 4, 1975 [IT] Italy ..... 26062 A/75

[51] Int. Cl.[2] ..... D06B 3/12; D06B 21/00

[52] U.S. Cl. ..... 68/5 E; 68/9; 68/202; 118/65; 118/67

[58] Field of Search ..... 68/5 D, 5 E, 9, 19.1, 68/202; 118/65, 67

[56] References Cited

U.S. PATENT DOCUMENTS

| | | | |
|---|---|---|---|
| 2,937,108 | 5/1960 | Toye | 118/65 X |
| 3,593,543 | 7/1971 | Bergman | 68/5 D |
| 3,609,781 | 10/1971 | Dunderdale | 68/5 D X |
| 3,757,545 | 9/1973 | Laney et al. | 68/202 X |
| 3,807,950 | 4/1974 | Rogers | 68/5 D X |
| 3,811,834 | 5/1974 | Schwemmer et al. | 68/202 X |

FOREIGN PATENT DOCUMENTS

| | | | |
|---|---|---|---|
| 1,105,062 | 3/1968 | United Kingdom | 68/5 D |
| 1,197,180 | 7/1970 | United Kingdom | 68/202 |

*Primary Examiner*—Philip R. Coe

[57] ABSTRACT

An apparatus is described for continuously dyeing textile fabrics. The apparatus may be best described in terms of its operation as follows: The fabric is preheated in a chamber and then impregnated with a bath consisting of dyestuff dissolved in a solvent in another chamber. Then the fabric is treated in a developing chamber where the dyestuff is fixed thereon by evaporation of the solvent. The excess solvent is then eliminated from the fabric in a water vapor atmosphere. The treatment in the developing chamber is effected by passing the fabric continuously and alternately a plurality of times to and from a zone of saturated solvent vapor and a zone of superheated solvent vapor. The solvent in these two zones is substantially the same as the solvent in the bath.

5 Claims, 3 Drawing Figures

APPARATUS FOR CONTINUOUS DYEING OF TEXTILES

The present invention relates to an apparatus for the continuous dyeing of textile fabrics in a solvent bath and, particularly, in an organic solvent bath.

It is well known that present day processes for dyeing textiles, for example knitting fabrics and the so-called "unwoven fabrics" and in general the so-called textile fabrics - as hereinafter specified - utilize water as the dyeing vehicle. The fibers of the textile are thus dyed through the permeation of the aqueous coloring solution in the fibers.

It is equally known that certain types of fibers, such as polyesters, may be dyed satisfactorily only by means of apolar organic solvents, particularly containing Cl ions therein. Other types of fibers require organic solvents which contain specific and various liquid additives such as water, rejecting however the water itself as the sole vehicle for the dyeing operation. On the other hand, the use of apolar organic solvents has shown to be a convenient and useful means for dyeing natural fibers and artificial or synthetic fibers of all types, said solvents offering substantial advantages over the employment of mere water as vehicle for the dyeing operation. It has been found through tests and evaluations that the employment of an organic solvent, instead of water, in dyeing baths results in a considerable savings of dyestuff, which dyestuff is fully transferred to the inner regions of the fabric being dyed. Concurrently, by using an organic solvent instead of water, bath solutions may be used which have a lower weight ratio of liquid to fabric. Furthermore, a superior penetration of the dyestuff in the fabric is obtained, and the textile product has a final superior appearance and receives a good dye application without damage to the fibers proper and is more resistant to running when washed and to light-discoloration.

Nevertheless, the use of organic solvents in the dye industry is still in the experimental phase because no apparatus has heretofore been developed which is capable of successfully continuously dyeing fabrics by means of a solvent as the vehicle, an apparatus, that is, capable of being introduced in the overall treatment of the fabric and of cooperating with the other steps of the process (washing, degreasing, finishing, drying, etc.)

It has now been developed, and forms the main object of the present invention, an apparatus for continuously dyeing of textile fabrics which consist substantially of polyamidic, modified cellulosic and, preferably, polyester fibers, in a solvent bath.

It is to be understood that the term "solvent" as used herein is meant to signify a liquid bath consisting of an apolar organic solvent, for example halogenated hydrocarbons and preferably perchloroethylene, optionally containing one or more liquid additives such as, for example, water.

Briefly stated, the apparatus of the present invention, expressed in terms of its operation, comprises the steps of: (a) preheating the textile fabric, (b) applying to said fabric at least one bath consisting of solvent-dissolved dyestuff or solvent-dispersed dyestuff which has good affinity with the fibers being dyed, (c) passing the fabric through a heated developing chamber for fixing the dyestuff onto the fabric by means of the evaporation of the solvent, and (d) vapor-treating the fabric by passing it through a chamber containing saturated water vapor, in order to obtain the complete application of the residual solvent thereto, the process having the feature that in the above-mentioned developing chamber the fabric is subjected to a continuous plurality of passages from a zone of saturated solvent vapors to a zone of superheated solvent vapors. The solvent in the developing chamber is substantially the same as the solvent in the baths applied to the fabric and containing the dyestuff.

According to a particular feature of the present invention, the condensation of the solvent vapors in the developing chamber is prevented so that the solvent does not drip back onto the fabric itself. To this effect, all of the surfaces of the fabric, except the most remote ones, are heated so that the solvent which may drip thereon is immediately re-evaporated and recycled.

It is to be observed, furthermore, that in practical operation, the evaporation of the solvent for the elimination of any trace of solvent and for the final deodorizing of the fabric need not be carried out immediately following the developing chamber, because there may be inserted other intermediate operations, such as washing, additional fabric treatments, drying, etc. It is, therefore, understood that the solvent evaporation step may be effected as the last phase of the entire operation.

Other objects and advantages of the apparatus of the present invention will become apparent from the following detailed description thereof, with reference to the accompanying drawings, in which.

Figure 1:
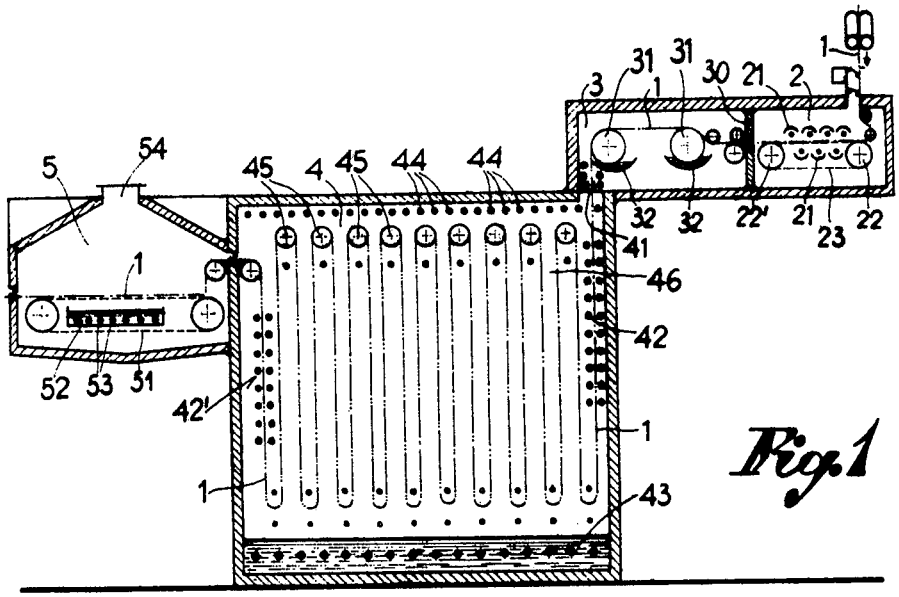
FIG. 1 is a sectionalized schematic view of a dyeing apparatus according to the invention.

Referring now to the drawings, a textile fabric 1, which — as described hereabove - may be a knitted fabric, an unwoven fabric or the like and may consist of natural or artificial (synthetic) fibers, is introduced by means of mechanically known, tension-less or tension-compensated or tension-regulated means into a preheating chamber 2 where, passing between a pair of rollers 22 and 22', is heated by means of conventionally known heating means 21. Heating means 21 may be, for example, an electrical resistance, a heated tube or heated coil utilizing vapors, hot water, diathermic oils or heated air. Furthermore, heating means 21, as illustrated, may preferably be located, at both extremities of a metallic mesh conveyor belt 23 onto which the fabric 1 is passed without tension. Fabric 1 is brought, thusly, to a constant temperature of between 60° C and 140° C, said temperature being suitably regulated. In the case of polyester fibers, the optimum temperature is 120° C. It is within the knowledge of the artisan to provide for suitable means of thermal regulation, so that the temperature be automatically maintained at the desired degree.

From the preheating chamber 2, the fabric 1 is passed to a second chamber 3 where the dyeing bath is applied thereto. Chamber 3 is separated from preheating chamber 2 by an insulating wall 30. In the bath chamber 3 there are located one or more smearing rollers 31 in series. Two such rollers are shown in FIG. 1. FIG. 1 is brought in contact with rollers 31 without tension. Each roller 31 is provided with an independent motor, so that the velocity of rotation of each roller may be varied at will. Furthermore, each roller 31 dips partially into a bath 32 consisting, as already described, of a dyestuff (known per se) dissolved or dispersed in an apolar organic solvent, preferably chloridized, and optionally containing liquid additives. Each roller 31, rotating about its axis, contacts the fabric 1 with a liquid film derived from the bath 32 which is maintained by means of a suitable heat exchanger (not shown) to a temperature of between 60° C and 100° C, preferably 70° C. Means for the automatic control of the bath temperature are obviously possible and within the knowledge of the artisan. It is to be observed that there may be more than a single bath in chamber 3, in that various and different dyestuffs may be used in each bath, so as to obtain special dyeing effects achievable only through a superposition of different dyestuffs. The amount of film applied onto the fabric by the rollers 31 may vary, depending on the level of the bath within the containing vessel and on the peripherical speed of rotation of each roller, the latter being obviously a function of the variable speed of the respective independent motor.

Figure 2:
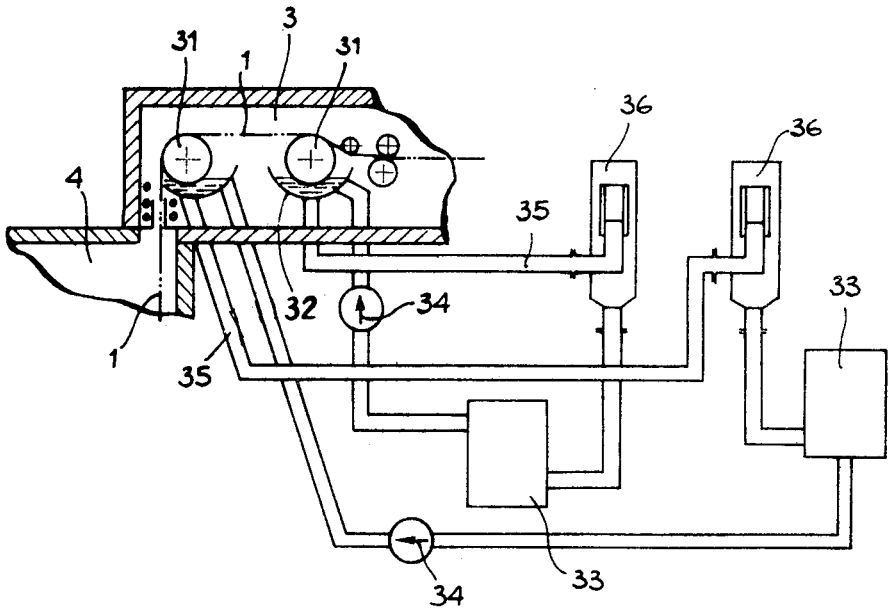
FIG. 2 is a sectionalized illustration of the application of two successive dyeing baths.

According to a particular feature of the invention, each bath is continuously stirred by means of a recycling system, which permits the maintaining of a constant and uniform bath concentration as well as a uniform bath temperature. The bath is continuously fed by its respective tank 33 - see FIG. 2 — by means of a feed pump 34. The discharging from bath 32 occurs also continuously via a drain conduit 35 at the bottom of the bath vessel which conduit is connected to a surge tank 36. The height of surge tank 36 may be regulated so as hydrostatically predetermine the desired level of liquid in each bath 32. When roller 31 is not in motion, the liquid in the bath 32, fed by pump 34, when a preestablished level is reached, is drained to the surge tank 36 and recycled to the feed tank 35. Conversely, when the roller 31 is in operation, only the liquid in excess of that applied by the roller 31 to the fabric 1 is returned to the surge tank 36.

The quantity of film applied to the fabric may thusly be varied, depending on the speed of rotation of the roller 31 and/or on the level of the bath determined by the position of the surge tank 36. The variation may change from 100% to 400%, preferably 300%, with respect to the weight ratio of liquid to fabric. It is important, as stated hereabove, that the fabric be dragged positively through the bath chamber 3 and that the contact with rollers 31 occur without pressure, except for the pressure exerted by the weight of the fabric itself, namely without the fabric being depressed.

Turning to FIG. 1, the fabric 1, after having been impregnated with the liquid from the bath 32 is passed, always without tension, into the developing chamber 4 while remaining at the predetermined temperature of 60°-140° C originally set in the preheating chamber 2. To avoid that the fabric loses heat while passing into chamber 4, which diminution in temperature would result in condensation of the solvent and consequent dripping of the condensed solvent onto the fabric, the fabric meets with a heat source suitably a heat exchanger 41.

Chamber 4 is so constructed as to define therein two superimposed zones; the lower zone is characterized by the presence therein of saturated solvent vapor, while the upper zone is characterized by the presence therein of superheated solvent vapor. The superheating temperature being up to 50° C above the boiling point of the solvent. The superheated condition is achieved by heating a given quantity of solvent present at the bottom of chamber 4. This solvent is of the same type as that contained in the bath 32, but is free from dyestuff. The heating for obtaining saturated solvent vapor in the lower zone is achieved by means of any suitable thermal means, such as for example a series of tubular conduits 43 immersed in the liquid solvent and vapor-heated. The superheating in the upper zone is obtained by means of heat exchangers 42, 42' located along the side walls of chamber 4 and by means of an additional heat exchanger 44 positioned along the ceiling of the chamber. Dimensioning and positioning of the various heat exchangers is well within the knowledge of the artisan and needs only to result in the definition of the two above-mentioned zones of different temperature, a central equilibrium zone being thus formed between the upper and lower zones, which intermediate zone may be raised or lowered depending on the temperatures of the adjoining zones.

Fabric 1 passes through chamber 4 along a zigzagged path determined by a plurality of guide rollers 45 located opposite to one another and near the ceiling and bottom, respectively, of chamber 4. Fabric 1, advancing from one roller to the next one, must continuously traverse in the vertical sense, ascending and subsequently descending, substantially the entire chamber 4, passing alternately from the saturated vapor zone to the super-heated vapor zone. In this manner, the natural convective motion of the vapor is assisted by the continuous ascending and descending displacement of the fabric which conveys with itself a portion of the vapor. The duration of the retention time in chamber 4 may vary from 1 to 20 minutes.

It was unexpectedly discovered that this continuous travel of the fabric from the saturated vapor to the superheated vapor, and back again, lends unexpected results to the fixing of the dyestuff onto the fabric. Probably this is due to the prevention of a rapid evaporation of the solvent impregnated onto the fabric in chamber 3. By slowing down the rate of evaporation of the solvent, the dyestuff has sufficient time to impregnate fully the inner regions of the fibers and to be distributed more uniformly on the fabric.

It is believed, although theorized, that this phenomenon be aided also by a continuous opening and closing of the fibers during the passage to and from the saturated vapor and the super-heated vapor. Such behavior is believed to assist in the fixing of the dyestuff within the fibers. Whatever the real explanation, it is evident that the solvent serves the function of vehicle for the transportation of the dyestuff into the inner regions of the fibers and for the uniform distribution of the colorant.

From the above it is clear that, in order not to interfere with the above-discussed phenomenon occurring during the passage of the fabric from one zone to the other, no condensation of the solvent may be had on the fabric. This prevention is insured by the initial heater 41. Furthermore, it must also be prevented that condensation dripping, collected elsewhere, occur on the fabric; to effect this, the upper heat exchanger 44 serves also the purpose of maintaining the ceiling of chamber 4 in heated condition so as to avoid vapor condensation thereon. Similarly, heat exchangers 42 and 42' prevent solvent condensation on the side walls which are quite near the path of the fabric and on which walls condensation could occur. For the same purpose, there are also provided additional heating means 46 so as to avoid any condensation on the rollers 45. These additional heaters also aid in the superheating of the upper zone of chamber 4. The recycle of the solvent within chamber 4 is insured by the condensation thereof which takes place instead on the frontal and rear surfaces or walls (not shown) of chamber 4, which surfaces are relatively spaced from the fabric 1. There is therefore no danger of condensation dripping on the fabric from these two walls. The condensate instead runs down along these frontal and rear walls to terminate at the bottom of the chamber.

As stated heretofore, the motion of the fabric in chamber 4 is a positive and tensionless drag. If unexpected stretching or buckling of the fabric occurs, this is compensated by varying the speed of rotation of the rollers in a manner known to the artisan, the detection of any such variation in tension being effected in a manner known per se, for example mechanically, electrically, hydraulically, photoelectrically, etc.

It is important that, prior to exiting from chamber 4, the fabric passes through the superheated zone, as illustrated, so as to leave that chamber with a temperature approximating the vaporization temperature of the solvent and, consequently, with a minimum content thereof. The last phase in the dyeing process, according to the present invention, is the treatment of the fabric with an aqueous saturated vapor as replacing the solvent still present in the fibers, said aqueous saturated vapor having greater affinity for the fibers than the solvent proper.

This process step is carried out in a vaporization chamber 5, through which the fabric 1 is passed without tension by merely resting it on a metallic mesh conveyor belt 51. The upper run of the belt 51 passes through the aqueous vapor originated from a container 52 containing water and heat by suitable means 53 such as, for example, an electrical resistance or a tube exchanger. The aqueous vapor developed through the fabric 1 contacts the fibers and replaces, because of its greater affinity with the fabric, the remaining traces of solvent present therein with water vapor. The aqueous vapor, admixed with the solvent vapors is then conveyed through flue 54 and passed to a solvent recovery unit (not shown) for re-use.

Figure 3:
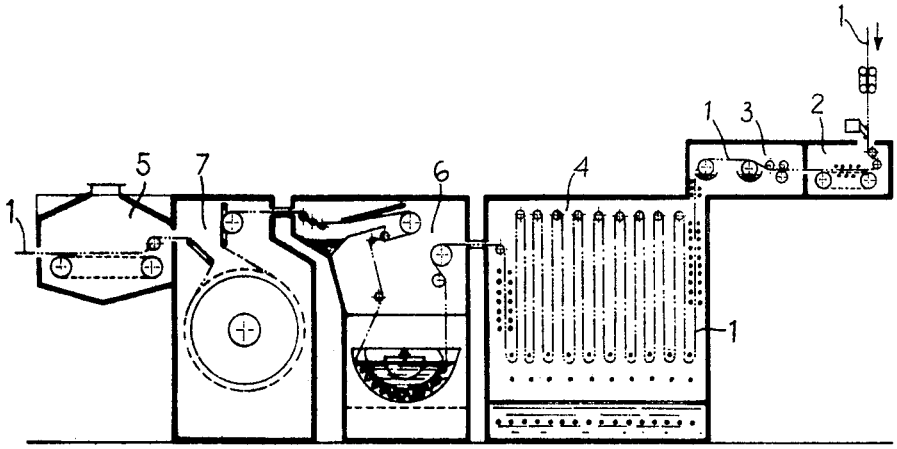
FIG. 3 is a sectionalized schematic longitudinal representation of a dyeing and washing operation.

Referring now to FIG. 3, there is shown an apparatus for dyeing a fabric, in which apparatus the fabric 1 is subjected, upon exiting from the developing chamber 4, to a washing operation in a continuous washing unit 6 and, thence, it is passed to a dryer 7 prior to being fully deodorized in a vaporization chamber 5. The intermediate washing step is effected in order to eliminate any eventual excess of dyestuff which has not been fixed onto the fabric. It is also effected in order to achieve, if so desired, a full degreasing of the fabric.

It is clear from the afore description that the process of the present invention lends itself to evident advantages over the processes of the prior art. The continuous recycle of the bath or baths minimizes the quantity of solvent and dyestuff employed and maximizes their utilization in that the dyestuff is substantially fully used on the fabric without waste. Furthermore, the method of application of the solvent to the fabric, by means of rollers, as described, does not damage the fibers which are never subjected to undue tension along their entire path.

As to the results obtained in experimental units by the Applicants, there were positively observed an increase in shine, uniformity and color-fastness in the dyestuffs applied.

It is to be understood that modifications and variants may be made to the process of the present invention and/or to the apparatus therefor, without however departing from the scope and spirit of the invention.

What is claimed and it is desired to secure by Letters Patent of the United States is:

1. Apparatus for continuously dyeing a textile fabric, which comprises, in combination:

(a) a pre-heating chamber for heating said fabric to a predetermined temperature;

(b) a bath chamber containing at least one bath consisting of dyestuff dissolved in a solvent, and at least one roller partially immersed in said bath for applying said dyestuff onto said fabric;

(c) a developing chamber for fixing said dyestuff onto said fabric, and having first and second side walls, ceiling and flooring, and being divided into an upper zone of superheated solvent vapor and a lower zone of saturated solvent vapor and further containing:

(i) a plurality of guide rollers positioned near said ceiling and said flooring for advancing said fabric from said first to said second side wall and alternately through said zones;

(ii) a first group of heating means positioned near said flooring to create said saturated solvent vapor in said lower zone;

(iii) second and third groups of heating means, positioned at said first and second side walls, respectively, to create said superheated solvent vapor in said upper zone and to prevent condensation of said solvent on said walls;

(iv) a fourth group of heating means positioned near said ceiling to assist in the creation of said superheated solvent vapor in said upper zone and to prevent condensation of said solvent on said ceiling;

(d) a vaporization chamber containing aqueous saturated vapor for removing said solvent from said fabric, and means for creating said aqueous saturated vapor therein.

2. The apparatus according to claim 1, wherein said developing chamber further contains heating means positioned near said guide rollers in said upper zone to prevent condensation of solvent on said rollers in said upper zone and to further assist in the creation of said superheated solvent vapor in said upper zone.

3. The apparatus according to claim 1, wherein said vaporization chamber is positioned adjoining said developing chamber and is in communication therewith at a location in said upper zone.

4. The apparatus according to claim 1, wherein said vaporization chamber is separated from said developing chamber by at least one intervening fabric washing and degreasing zone and one fabric drying zone.

5. In an apparatus for continuously dyeing a textile fabric and comprising a chamber for preheating said fabric, a chamber for applying onto said fabric a dyestuff solvent solution, a chamber for fixing said dyestuff onto said fabric and vaporizing off from said fabric said solvent, the improvement comprising a developing chamber for fixing said dyestuff onto said fabric, said developing chamber comprising:

(a) first and second side walls;

(b) a ceiling;

(c) a flooring;

(d) an inner upper zone of superheated solvent vapor;

(e) an inner lower zone of saturated solvent vapor;

(f) a plurality of guide rollers positioned near said ceiling and said flooring for advancing said fabric from said first to said second side wall and alternately through said zones;

(g) a first group of heating means positioned near said flooring to create said saturated solvent vapor in said lower zone;

(h) second and third groups of heating means positioned at said first and second side walls, respectively, to create said superheated solvent vapor in said upper zone and to prevent condensation of said solvent on said walls; and (i) a fourth group of heating means positioned near said ceiling to assist in the creation of said superheated solvent vapor in said upper zone and to prevent condensation of said solvent on said ceiling.

* * * * *